US007591393B2

(12) United States Patent
Crudgington, Jr.

(10) Patent No.: US 7,591,393 B2
(45) Date of Patent: Sep. 22, 2009

(54) DISPOSABLE DRINKING CUP LID

(76) Inventor: Cleveland Benedict Crudgington, Jr., 222 N. Myrtle Ave., Monrovia, CA (US) 91016-2243

( * ) Notice: Subject to any disclaimer, the term of this patent is extended or adjusted under 35 U.S.C. 154(b) by 0 days.

(21) Appl. No.: 11/047,399

(22) Filed: Jan. 31, 2005

(65) Prior Publication Data

US 2005/0173443 A1 Aug. 11, 2005

Related U.S. Application Data

(60) Provisional application No. 60/542,237, filed on Feb. 6, 2004.

(51) Int. Cl.
*A47G 19/22* (2006.01)

(52) U.S. Cl. ..... 220/713; 215/388; 222/571

(58) Field of Classification Search ..... 220/711–719, 220/731, 734, 703, 705; 222/566, 571, 570; 215/387–389, 229

See application file for complete search history.

(56) References Cited

U.S. PATENT DOCUMENTS 4,589,569 A 5/1986 Clements
4,767,019 A 8/1988 Horner
5,065,880 A 11/1991 Horner
5,253,781 A * 10/1993 Van Melle et al. ..... 220/713
5,624,053 A 4/1997 Freek et al.
5,839,601 A 11/1998 Van Melle
5,890,621 A 4/1999 Bachman et al.
6,419,112 B1 7/2002 Bruce et al.
6,523,712 B1 2/2003 McGushion
6,561,376 B2 * 5/2003 Price et al. ..... 220/669
6,612,456 B1 * 9/2003 Hundley et al. ..... 220/254.3
6,644,490 B2 11/2003 Clarke
6,679,397 B2 1/2004 Smith et al.
6,702,145 B2 * 3/2004 Malcolm ..... 220/713
6,886,707 B2 * 5/2005 Giraud ..... 220/254.4
6,905,044 B1 * 6/2005 Russo et al. ..... 220/719
6,929,143 B2 * 8/2005 Mazzarolo ..... 220/254.3
7,178,685 B2 * 2/2007 Hidalgo ..... 220/229
2003/0089714 A1 * 5/2003 Dart et al. ..... 220/254.3

* cited by examiner

*Primary Examiner*—Lien T Ngo
(74) *Attorney, Agent, or Firm*—Seed IP Law Group PLLC

(57) ABSTRACT

A disposable drink-through dome lid for disposable drinking cups used in the sale of hot or cold beverages. In order to extend the volume within the cup, the top surface of the lid is elevated above the top surface of the beverage cup when in place, and is encompassed by an annular ridge that includes a generally oval-shaped opening for drinking. In its preferred form the ridge is not continuous around its perimeter but is partially recessed on both sides of opening. In its preferred embodiment the generally oval-shaped opening includes a barrier that projects downward from the opening's perimeter thereby providing shielding against accidental spillage due to sloshing of the beverage while transporting or consuming in a moving vehicle.

22 Claims, 4 Drawing Sheets

DISPOSABLE DRINKING CUP LID

RELATED U.S. APPLICATION DATA

Continuation-in-part of Provisional Patent Application, No. 60/542,237, Feb. 6, 2004.

U.S. PATENT DOCUMENTS

| | | | |
|---|---|---|---|
| 4,589,569 | May 1986 | Clements | 220/380 |
| 4,767,019 | August 1988 | Horner | 220/90.4 |
| 5,065,880 | November 1991 | Horner | 220/711 |
| 5,253,781 | October 1993 | Van Melle et al. | 220/713 |
| 5,624,053 | April 1997 | Freek et al. | 220/713 |
| 5,839,601 | November 1998 | Van Melle | 220/712 |
| 5,890,621 | April 1999 | Bachman et al | 220/717 |
| 6,419,112 | July 2002 | Bruce et al. | 220/781 |
| 6,523,712 | February 2003 | McGushion | 220/713 |
| 6,644,490 | November 2003 | Clarke | 220/254.1 |
| 6,679,397 | January 2004 | Smith et al. | 220/254.1 |

FIELD OF THE INVENTION

This invention relates to disposable lids for beverage cups; and, more particularly, the present invention is directed to disposable dome lids which may be placed over the lip of a beverage cup and which provides a drink-through opening near the perimeter of the lid's top surface for easy drinking access to the beverage.

BACKGROUND OF THE INVENTION

Disposable dome lids with a drink-through opening that affix to disposable beverage cups have become extremely popular as a means for merchants to provide a wide variety of carry-out hot and cold beverages to the consumer. The many benefits of dome lids have been described in detail within prior art and are well-known to the general public.

All disposable dome lids are designed to grip and seal upon an outwardly projecting bead formed at the lip of disposable cups intended for this purpose. Two methods for attaching disposable dome lids to cups have been described in prior art and are commonly used in practice. The original method provides an annular outwardly projecting groove that snaps into place when pushed over the lip of the cup. Because of the flexibility of the plastic material used in the manufacture of disposable lids, the annular apron at the lid's base is able to momentarily expand while sliding over the bead surrounding the lip of the cup. When in place the annular groove grips the annular bead thereby holding and sealing the lid to the cup. Rather than having an outwardly projecting groove, disposable dome lids employing the newer method of attachment have an inverted annular groove surrounding the lid's base and forming what is referred to as a "plug fit". When attached, the cup's lip extends into the inverted groove that applies pressure not only to the cup lip's outer edge but to the inner edge as well. The plug fit method, by applying pressure to both sides of the cup's edge, eliminates the possibility of the cup's lip caving inward causing the seal to break. For this reason, the plug fit can be applied to less expensive cups having a weaker sidewall, and in that regard is considered an improvement over the earlier method.

The present invention is set forth suggesting the first method of attachment for illustration purposes, yet it is not the intent of the examples contained herein to preclude one method over the other since all embodiments disclosed herein are applicable to either. The present invention recognizes that both methods are commonly and successfully used commercially.

Regardless of the means for attaching to a cup, disposable drink-through dome lids presented in prior art can be can be grouped into three distinct types: those that provide a comparatively larger drink-through opening by means of a tear-back flap; those that provide a small drink-through opening positioned within a reservoir having a sidewall that aligns with the user's mouth; and those that provide a drink-through opening by means of a small preformed usually elongated opening intended to be enclosed by the user's mouth during consumption.

Each of these three types of drink-through lids has inherent advantages and disadvantages. The fold or tear-back flap permits the beverage to be mostly sealed within the cup while being transported prior to consumption. Additionally, the beverage is consumed in a manner most similar to drinking from a conventional drinking cup. However, once the flap has been opened, the cup cannot be easily moved about without risking spilling its contents. Since no provision is made for retaining the beverage that sloshes out through the opening, this type of disposable lid is not suitable for users wishing to consume their carry-out beverage while traveling. The second type of disposable drink-through lid addresses this problem by providing a reservoir which surrounds the drink-through opening. Beverage that sloshes out through the opening, is contained within the reservoir and eventually drains back into the cup. This feature arrests most spills that might otherwise occur while the cup is vertically placed within a moving vehicle. However, this lid is vulnerable to spills from the moment the beverage passes through the opening and prior to entering the user's mouth. Thus, if the user were to be jostled during that time, as when riding over a bump while sipping the beverage, the exposed contents would likely be ejected into the air resulting in a spill. For this reason, although this type of lid is improved for travel, neither are preferable for beverage consumption in a moving vehicle.

With many consumers on the go, carry-out beverages are more often than not intended to be consumed in moving vehicles. Disposable lids, of the kind that provide a seal between the user's mouth and the drink-through opening, have proven best suited for prevention of spills during consumption while traveling. This is based on the wide-spread acceptance of this type of lid used by take-out establishments. However, there are limitations with this type of drink-through dome lid which are addressed by the present invention. And with the growing consumption of beverages within moving vehicles, the need for these improvements has never been greater. Of greatest concern is the safety to the user behind the steering wheel. Besides the annoyance of soiling one's clothes, the sudden distraction resulting from a spill could result in an automobile accident.

Dome lids that provide means for a seal between the user's mouth and the drink-through opening have a number of concerns, the most important being that the beverage is vulnerable to spilling out through the drink-through opening when a relatively full cup is being jostled about. A second smaller hole is typically placed within the deepest point of a recess provided for the user's upper lip directly behind the drink-through opening so that spilled liquid caught in the recess can drain back into the cup. Even though the drain hole is relatively small, because of its proximity to the drinking hole, liquid having a low viscosity such as coffee can easily dribble out through this hole while the cup is being tilted for consumption. Also, a third equally small hole is recommended to alleviate the vacuum formed by the discharging liquid, but also provides another source for accidental spillage. It should be noted that other patents in related art have described this type of dome lid as having another inherent detriment. They are referring to the need to suck the liquid through the small drink-through opening in order to obtain the desired volume of beverage. However, the widespread acceptance of this type of lid would suggest that the need to suck the beverage from the container is not viewed by the user as an irritant nor a detriment.

The present invention provides improvements to this type of drink-through lid, namely those having a preformed drink-through opening intended to be enclosed by the user's mouth, by providing enhancements that minimize spillage from sloshing and enhancements in the contact between the lid and the user's mouth. With the proliferation of fast-food and carry-out beverage outlets geared to serve busy customers on the go, there is a growing need for a lid that further reduces accidental spills. Prevention of vehicle accidents is of paramount importance and presents a safety concern for the carry-out industry. But particularly annoying is the more frequent occurrence of spills resulting in the soiling of business attire while commuting to work or the soiling of evening attire while riding to an important social outing.

DESCRIPTION OF THE PRIOR ART

Two United States patents, illustrative of the two types of disposable dome lids outside the scope of the present invention, are suggested for reference: Van Melle U.S. Pat. No. 5,839,601 teaches a disposable dome lid with a fold or tear-back flap that forms a drink-through opening; and Bruce et al. U.S. Pat. No. 6,419,112 teaches a disposable dome lid containing a reservoir that surrounds a drink-through opening. Clements and Clarke provide certain basic teachings of the features of disposable drink-through dome lids most pertinent to the present invention, namely those having a drink-through opening that is intended to be fully enclosed by the user's mouth during consumption of the beverage contained therein.

CLEMENTS U.S. Pat. No. 4,589,569 teaches disposable dome cup lids pertinent to the first and second principal embodiments of the present invention. Clements discloses a dome lid which is placed over the lip of a beverage cup, and which extends above the top of the cup so as to provide additional volume. A small punched drinking hole is located in an elevated annular ridge formed at the top of the cup lid. Even though elevated above the cup's lip, the drink-through opening may not preclude spillage due to jostling of the cup. Two other openings are described by Clements, one for draining spilled liquid and another for venting purposes. The introduction of these openings as taught by Clements introduces additional opportunities for spillage. Clements further describes a recess behind the drink-through opening intended for accommodating the user's upper lip, thereby forming an annular ridge about the drink-through opening. This ridge is intended to be sealed by the user's upper and lower lips yet Clements fails to address the means by which the user's upper and lower lips would best form a seal about the drink-through opening.

CLARKE U.S. Pat. No. 6,644,490 teaches a dome lid as taught by Clements with the introduction of a press-out tab formed outside the annular periphery of the lid during manufacturing. Clarke discloses means to prevent accidental spillage by providing an inexpensive and convenient method to plug the drink-through opening during times that the beverage is not being consumed. While this teaching provides novel means for sealing the drink-through opening, this method is likely to prove cumbersome for users who frequently sip their beverage while driving a vehicle. The tab must be repeatedly engaged and disengaged with every sip. Additionally, the procedure cannot be easily accomplished without the use of both hands, namely one hand to hold the cup while the other operates the tab. Furthermore, the addition of a tab suspended to one side of the lid may prove annoying to the immobile user who has no need for this feature.

Russo et al. U.S. Pat. Nos. 6,905,044 & 6,991,128 teach a dome lid as taught by Clements with the introduction of a recessed drinking opening. In order for a newly designed disposable drink-through lid to become a viable product, limitations inherent to the manufacturing process must be considered. Since disposable drink-through lids are typically formed from thermoplastic sheets using the vacuum-forming manufacturing process, the punching out of holes is a secondary operation that can only be performed after vacuum forming of the thermoplastic sheets. Drinking and vent holes along with the lid itself are punched out from the formed sheets. In order to be cost effective, all holes within the many lids formed within a single sheet, are punched out in a single die-punch operation using a motion normal (vertical) to the sheets. Many of the small holes within Russo's recessed drinking opening, referred to as apertures, would require being punched out with a horizontal motion, thus making Russo's invention prohibitively expensive to manufacture. Furthermore, the embodiments to the drinking opening described by Russo will not accommodate a drinking straw. In many circumstances, consumers want to insert a drinking straw through the lid. Establishments that sell take-out coffee and other beverages would likely not purchase lids that are unable to take a drinking straw.

Two additional United States patents provide certain basic teachings that have some relevance to the present invention, yet which teach cup lids that are not otherwise suitable for purposes of the present invention. They are:

HORNER U.S. Pat. No. 5,065,880 discloses a splash resistant cup lid designed to prevent spills and splashes caused by beverage sloshing. Even though not of the dome type, Homer recognizes the dynamics of sloshing liquids and the benefit of vertical drink-through openings, a fundamental element addressed by the third principal embodiment of the present invention. Homer describes a lid having an opening that comes generally sealed by means of a raised canopy with drink-through slits that remain closed until the canopy is depressed into the lid causing the slits to open and becoming somewhat vertically positioned. Homer teaches that sloshed liquids have a vertical component to their motion with respect to the cup lid, and by creating vertical rather than horizontal drinking openings, much of the fluid will be deflected back into the cup. With Homer's invention the sloshed contents will generally impact upon the depressed canopy rather than exit through the slits.

VAN MELLE et al. U.S. Pat. No. 5,253,781 discloses a dome lid with a raised volume-extending section and a drink-through spout above the upper surface of the volume-extending section. Van Melle attempts to overcome the disadvantages of prior art particularly in consideration of the accidental spillage of carry-out beverages in moving vehicles. The invention teaches spills due to sloshing are further reduced by elevating the drink-through opening above the volume-extending section. As effective as Van Melle's teaching may prove to be, it may not be preferred by the adult user in that drinking cups having lids with extended spouts are likely to be associated with non-disposable non-spill cups commonly designed for young children. This teaching is provided in the present invention since Van Melle recognizes the deficiency in the lid disclosed by Clements particularly the unsuitability of the lid's configuration surrounding the drink-through opening. Van Melle teaches that a generally rounded spout is more adaptable to the natural shape of the user's lips, therefore enabling the user to generate a liquid-tight seal with less effort.

SUMMARY OF THE INVENTION

In accordance with the present invention, three independent principal embodiments are set forth for a disposable cup lid having a pre-formed drink-through opening that is intended to be enclosed by the user during consumption of the beverage contained therein. Even though independent, the preferred lid contains all three principal embodiments which are applied but not limited to a disposable cup lid most closely set forth in Clements' U.S. Pat. No. 4,589,560. Clements' patent in brief describes a lid that includes an annular mounting portion for engaging with the cup's lip, an annular side wall extending upwardly from the mounting portion, a top wall having a drink-through opening and a recess behind the opening to accommodate the upper lip of the user. A drain hole is placed within this recess to permit spilled liquid to drain back into the cup. Also a vent is placed in the top wall generally opposite the drink-through opening to alleviate the vacuum generated by consumption of the cup's contents through a sealed drink-through opening.

While Clements and others provide teachings to a lid that facilitates drinking from a disposable cup through an opening with minimal spillage, the present invention provides further improvements to that end. Accordingly, a general object of the present invention is to provide a lid which further reduces the risk of accidental spillage that often occurs when a user carries and consumes a beverage such as hot coffee in a moving vehicle. Another general object of the present invention is to provide a lid that preserves or even enhances the comfort and appeal provided to the user through its function and design as provided by Clements. Another general object of the present invention is to provide embodiments that are suitable for vacuum-forming planar sheets of thermoplastics material as is customary for manufacturing disposable drink-through dome lids. Another general object of the present invention is to provide embodiments that permit the nesting of stacked lids to facilitate boxing for shipment and storage. A specific object of the present invention is to improve the ease of the user to orient his or her mouth to the drink-through opening within the lid while engaged in another activity such as driving a vehicle, by using tactile means rather than visual means. Another specific object is to improve the ease for the user to obtain a liquid-tight seal between the user's lips and the portion of the lid surrounding the drink-through opening. Another specific object is to improve the comfort for the user between the user's lips and the portion of the lid surrounding the drink-through opening. Another specific object of the present invention is to minimize spillage through the drink-through opening when the liquid within a relatively full cup sloshes within the cup, as is often the case while being transported within a moving vehicle. Another specific object of the present invention is to eliminate the possibility of spillage through the drain hole when the cup is tilted for consuming its contents. Another specific object of the present invention is to eliminate the possibility of spillage through the vent hole when liquid within a relatively full cup sloshes within the cup, as is often the case while being transported within a moving vehicle.

The first principal embodiment introduces improvements to the annular top surrounding the drink-through opening as taught by Clements. By reconfiguring a portion of the drink-through opening surrounding the lid to a shape that is more adapted to the user's lips, the present invention provides the means for the user to create a superior seal when applying his or her mouth to the lid. Not only is the seal improved, but the present invention provides a lid that is both visually appealing and more comfortable to the user's lips. Furthermore, this embodiment enables the user to more readily locate the drink-through opening by tactile contact with his or her lips, thus enabling the cup to be properly oriented for drinking without first having to make visual contact. This feature becomes beneficial when the user is visually distracted such as when driving a moving vehicle.

By introducing the means to combine the vent and drain holes, the second principal embodiment is provided. Clements rightfully discloses the need for both drain and vent holes, as well as the need to slope the described recess towards the drink-through opening in order to prevent over-stretching of the thermo-plastic material. Clements further suggests that the drain hole for the described recess be placed at its lowest point. However, because of the sloping within the Clements' described recess, the deepest point unfortunately is directly behind the drink-through opening. The present invention introduces means that enable the drain hole to be relocated away from the drink-through opening yet still remain within the recess taught by Clements. In doing so, the drain hole ceases to be a source for accidental spills, and can also serve the venting purpose thereby eliminating the need for a separate vent hole.

The third principal embodiment provides an improvement to all drink-through disposable dome lids having a generally oval-shaped drink-through opening. The present invention provides the means to restrict accidental spillage due to sloshing through the drink-through opening, which often occurs when a generally full cup is being transported within a moving vehicle. Additionally, the preferred embodiment includes the means to facilitate the full volume of liquid to flow into the users mouth when the cup is tilted in a conventional manner. Rather than further elevating the drink-through opening as taught by Van Melle, the third principal embodiment introduces an internal protective barrier that surrounds the drink-through opening thereby inhibiting spillage that would otherwise result from sloshing of the cup's contents. In its preferred configuration the embodiment does not impede the flow of beverage during consumption and permits the cup's entire contents to be emptied into the user's mouth. These means are achieved by providing a multiple of contiguous openings within the barrier having both vertical and horizontal components.

All three principal embodiments, their preferred configurations and as well as the objects of the present invention, will become apparent from the following descriptions and the accompanying drawings.

BRIEF DESCRIPTION OF THE DRAWINGS

The basic elements comprising the novel features which are believed to be characteristic of the present invention will be better understood from the following drawings. Whereas the preferred configurations of the improvements relating to the invention have been illustrated and described herein, it should be realized that the preferred embodiments are to be considered in all respects illustrative and not restrictive.

DETAILED DESCRIPTION OF THE PREFERRED EMBODIMENTS

Figure 1:
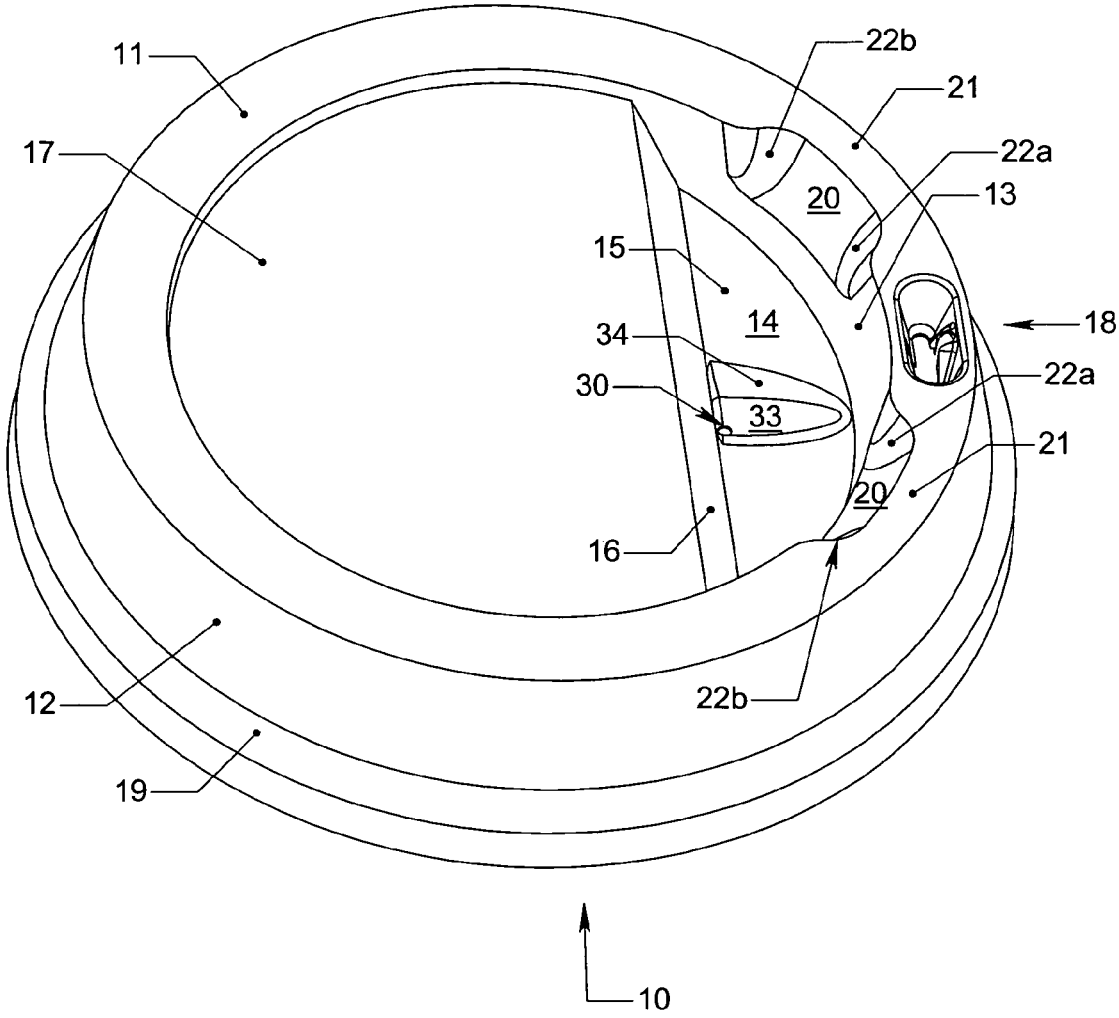
FIG. 1 is a perspective view illustrating the disposable dome lid with all of the preferred embodiments of the present invention.

FIG. 1 illustrates all three principal embodiments with the preferred configuration of the present invention 10. For disposable lids of the drink-through dome type that incorporate the first or second principal embodiment, lid 10 forms a substantially planar annular top wall 11 bounded on its outer perimeter by an annular outer sidewall 12 sloping downwardly and outwardly, and on its inner perimeter by an annular inner sidewall 13 sloping downwardly and inwardly, with both perimeters being substantially concentric to one another. A primary recess 14 is bounded by the arcuate portion of annular inner sidewall 13 and further defined by two substantially planar surfaces 15 & 16, with a bottom wall 15 gently sloping upwardly and inwardly from the arcuate portion of annular interior sidewall 13 and terminating at a interior sidewall 16. Interior sidewall 16 continues to slope upwardly and inwardly at a substantially steeper angle than bottom wall 15, where it terminates at an inner top wall 17. In the preferred configuration, inner top wall 17 is recessed slightly below annular top wall 11 with both being generally planar and parallel to one another. As taught by Clements, primary recess 14 accommodates the upper lip of the user by deepening annular inner sidewall 13 at a drink-through opening 18. The lower lip of the user is also accommodated by sufficiently raising outer sidewall 12 so the user's lower lip generally clears a mounting portion 19 formed at or near the base of outer sidewall 12 in order to affix the lid to a drinking cup.

Figure 2:
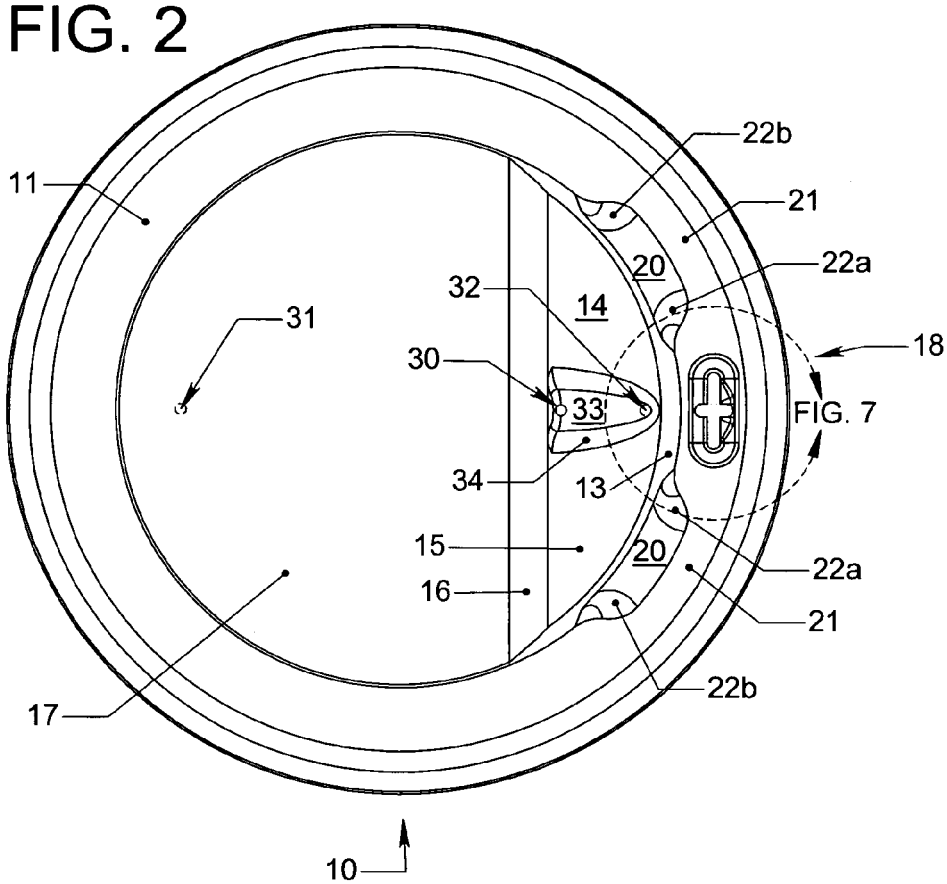
FIG. 2 is a top view illustrating the disposable dome lid with all of the preferred embodiments of the present invention.

Best visualized in FIGS. 1 & 2, the first principal embodiment of the present invention includes a pair of secondary recesses 20 sloping downwardly and inwardly within annular top wall 11, that are positioned on each side of the drink-through opening 18 generally at the two locations where the user's upper lip would make contact with the edge otherwise formed by the intersection of annular inner sidewall 13 and annular top wall 11. The pair of secondary recesses 20 results in the narrowing of annular top wall 11 at two locations 21 thereby providing an improved configuration surrounding drink-through opening 18. Each secondary recess 20 forms a pair of sidewalls 22*a* & 22*b* that slope downwardly and towards one another from annular top wall 11 thereby permitting the nested stacking of lid 10. Both sidewalls 22*a* being shaped and separated by drink-through opening 18 such that lid 10 conforms most effectively and comfortably with the user's upper lip. Visual symmetry within each secondary recess 20 is provided by mirroring the best suited curvature of sidewalls 22*a* in the shaping of sidewalls 22*b*.

Figure 3:
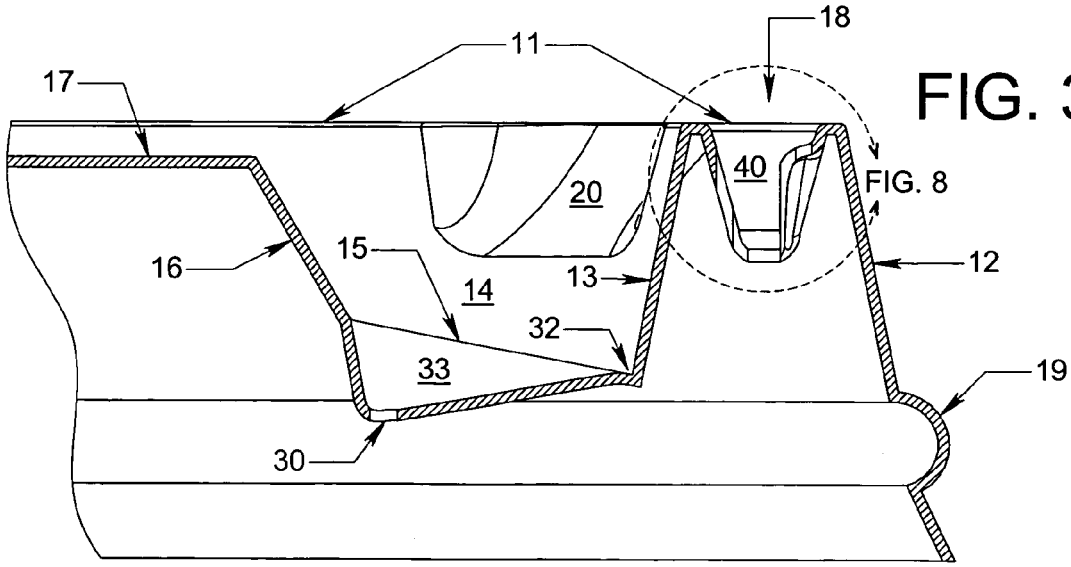
FIG. 3 is a cross-sectional fragmentary side view illustrating the disposable dome lid with all of the preferred embodiments of the present invention.

As shown in FIG. 2, dome lids of this type prior to the second principal embodiment of the present invention, typically required two additional openings: a vent hole 31 usually positioned within inner top wall 17; and a drain hole 32 positioned at the lowest level in primary recess 14 which was adjacent to drink-through opening 18. In this invention, vent hole 31 and drain hole 32 are effectively replaced by drain/vent hole 30 within primary recess 14. By including a recessed channel 33 within bottom wall 15, hole 30 can be effectively distanced from the drinking hole 18. Channel 33 initiates at the lowest point of annular inner sidewall 13 and terminates at interior sidewall 16. As shown in FIG. 3, channel 33 slopes downwardly and inwardly within the inversely sloping bottom wall 15. Drain/vent hole 30 positioned at the lowest level within channel 33, drains liquid trapped by primary recess 14 back into the cup without becoming submerged when the cup is tilted in a normal manner for drinking, thereby eliminating a source for spillage. Additionally, hole 30 is able to reliably vent air into the cup during beverage consumption thereby eliminating the need for vent hole 31 and another source for spillage. In its preferred configuration, channel 33 is sized sufficiently small in relation to primary recess 14 so that loss of volume by its inclusion within dome lid 10 becomes inconsequential. In order to visually blend channel 33 into primary recess 14, as most clearly visible in FIG. 1, the intersection of channel 33 and bottom wall 15 preferably have softened edges 34.

Illustrated in FIG. 3, in order to substantially restrict spillage through drink opening 18 caused by a sloshing beverage such as coffee within a cup being jostled about, a baffle 40 is formed downwardly from the perimeter of the drink-through opening 18, thereby providing the third principal embodiment of the present invention. While it will be understood that baffle 40 of the present invention may be configured in a number of effective ways to a variety of drink-through dome lids, a description will now be given that presents one effective manner of taking full advantage of the various features of the invention.

Figure 4:
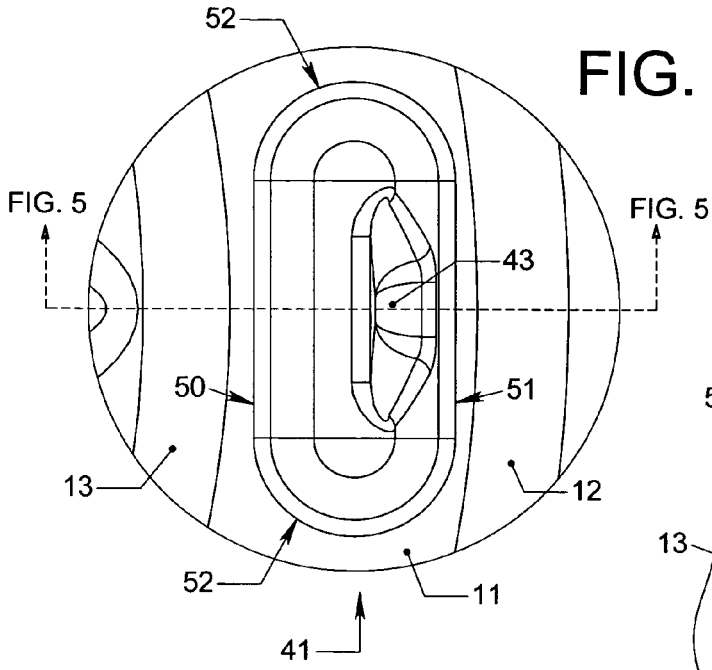
FIG. 4 is a fragmentary top view illustrating the preferred configuration of the third principal embodiment prior to stamping the drink-through opening.
Figure 5:
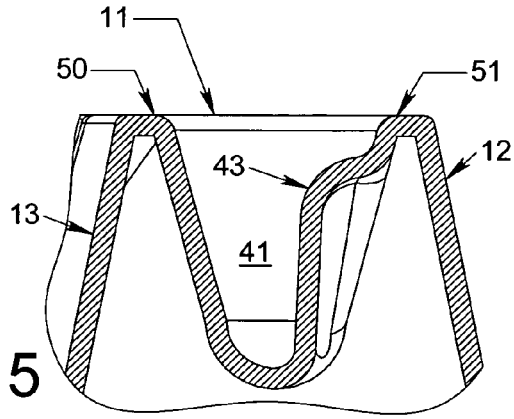
FIG. 5 is a fragmentary cross-sectional side view illustrating the preferred configuration of the third principal embodiment prior to stamping the drink-through opening.
Figure 6:
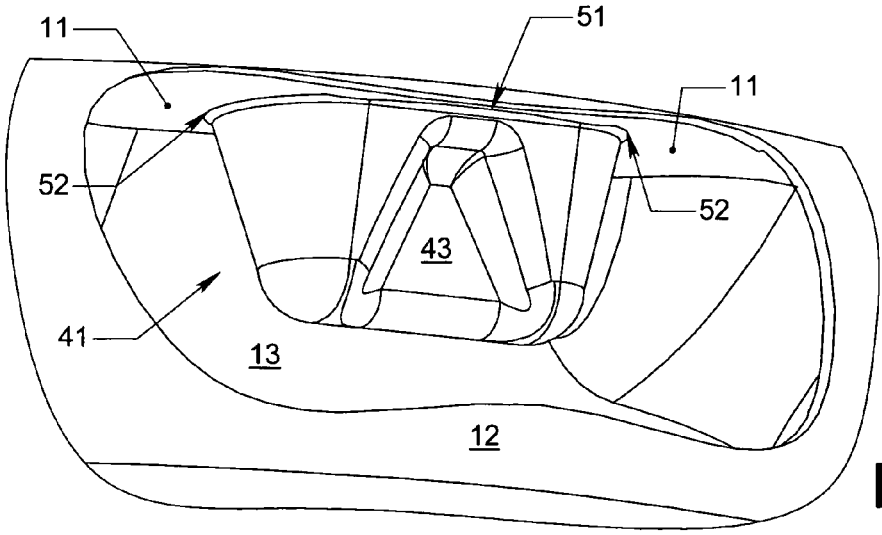
FIG. 6 is a fragmentary cut-away perspective view illustrating the preferred configuration of the third principal embodiment prior to stamping the drink-through opening.

Referring now to FIGS. 4, 5 & 6, in its preferred configuration the entrance to drink-through opening 18 is defined by a pair of parallel straight edges, inner edge 50 and outer edge 51, which are enclosed at each end by a pair of full radius edges 52. During the molding of lid 10, a fully sealed cavity 41 forms from edges 50, 51 & 52 extending downwardly and sloping inwardly upon itself. An inwardly facing depression 43 forms in the side of cavity 41 closest to outer sidewall 12 thereby increasing the slope of cavity 41 at that location to that of approaching vertical and provides a protrusion into the center of cavity 41 as seen most clearly in FIG. 5. The purpose of depression 43 will become apparent in FIGS. 7, 8 & 9 where the stamping of drink-through opening 18 into cavity 41 can be viewed providing useful opening portions that could not otherwise be formed.

Figure 7:
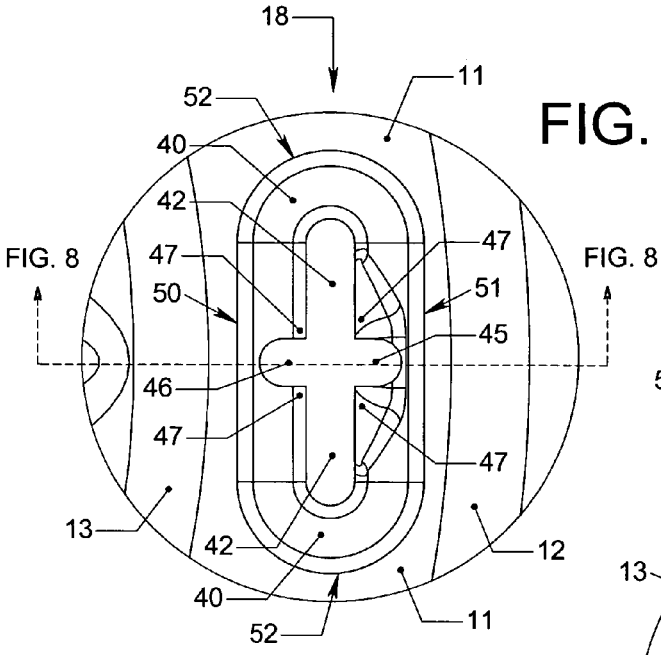
FIG. 7 is a fragmentary top view illustrating the preferred configuration of the third principal embodiment subsequent to stamping the drink-through opening.

Stamping of drink-through openings is a common secondary process subsequent to vacuum-formation of thermoplastic material. The stamping process consists of a vertically moving hardened metallic die impacting upon a softer metallic receiving surface with the thermoplastic material being supported by the receiving surface during the cutting process. In prior art, the manufacturing of disposable dome lids taught or implied the stamping of the drink-through openings with a planar or 2-dimensional cut. Thus, the suggested receiving surface used in die cutting was flat and the shape of the drinking hole stamped into the thermoplastic material was planar. The present invention introduces a stamped drinking hole incorporating a 3-dimensional shape. The formed thermo-plastic material is supported by matching the die's receiving surface to the 3-dimensional surface surrounding the underside of cavity 43. The preferred drink-through opening 18 set forth herein is created by placing a hole within the die's receiving surface that matches the footprint of opening 42 as seen in FIG. 7, and by providing a razor-sharp die that mates with and passes through the hole during the stamping operation. Understandably, the initial cost of the tooling used in performing the proposed stamping, is higher than that used in making a planar cut hole. However, since the steps used in production and post-production remain unchanged, the manufacturing costs are similar making the initial cost insignificant in high volume production.

In the suggested pattern shown in FIGS. 2 & 7, drink-through opening 18 when viewed from above generally appears in the shape of a cross having a footprint significantly smaller than that of a conventional drink-through hole suggested by perimeter defined by edges 50-52. But when viewed in perspective as in FIG. 9, the full benefit of the 3-dimensionally stamped hole can be realized with the stamping of cavity 41 resulting in the formation the preferred embodiment of the present invention.

Figure 8:
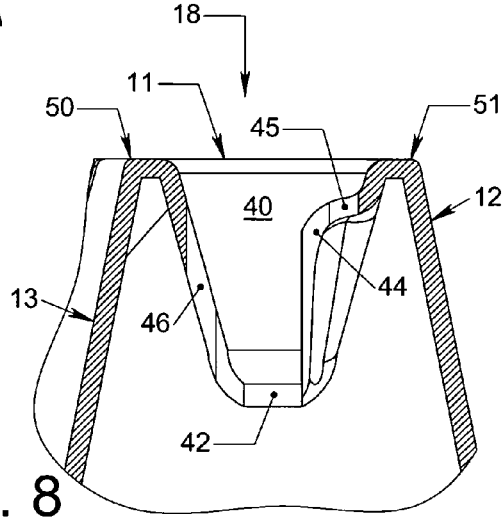
FIG. 8 is a fragmentary cross-sectional side view illustrating the preferred configuration of the third principal embodiment subsequent to stamping the drink-through opening.
Figure 9:
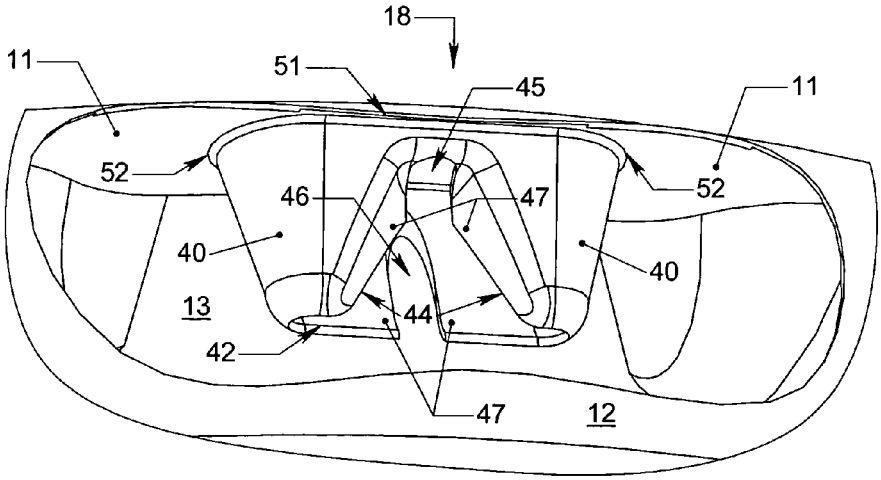
FIG. 9 is a fragmentary cut-away perspective view illustrating the preferred configuration of the third principal embodiment subsequent to stamping the drink-through opening.

Referring now to FIGS. 7, 8 & 9, the preferred shape of the stamped drink-through opening 18 is comprised of several contiguous openings, achieving these over-all benefits: to permit the full volume of liquid to pass through the drink-through opening 18 as if no baffle 40 were present; to enhance the effectiveness of baffle 40 in deflecting most of sloshing liquid away from drink-through opening 18; to allow the remainder of an almost empty cup to pass through the drink-through opening; and to permit the insertion of up to a 5/16" drinking straw. The full benefits of the preferred drink-through opening 18 can be best understood by comparing views FIGS. 8 & 9, which illustrate the means whereby a beverage is able to effectively pass through unimpeded during consumption while being substantially shielded when sloshed.

As shown in FIG. 9, an inverted "V"-shaped opening 44, formed from stamping depression 43 below outer edge 51 extends upwardly to form a small slotted opening 45. Beginning mostly vertical and ending mostly horizontal, slotted opening 45 provides the means for the remnants of the cup's contents to flow through baffle 40 when the cup is tilted in a normal manner. The inverted "V" opening 44 being wide at its base and substantially vertically oriented as shown in FIGS. 8 & 9, is able to permit a relatively large volume of liquid to pass through while under pressure as is the case when the cup is tilted for drinking. Yet inverted "V" opening 44 remains virtually hidden when looking directly down into the drink-through opening 18 as seen in FIG. 7. Thus, sloshing liquid having a generally vertical motion will be substantially deflected by baffle 40 prior to entering opening 44, thereby preventing an accidental spill.

Formed from stamping the planar surface of baffle 40 extending below inner edge 50, a slotted opening 46 is cut vertically downward to the bottom and is positioned directly opposite slotted opening 45, with both slotted openings 45 & 46 being generally of equal width. Openings 44 & 46 merge with the last slotted opening 42 stamped into the bottom of baffle 40, thereby joining all opening portions to form drink-through opening 18. The merging of opening 44 with 42 and opening 46 with 42 creates four flaps 47 capable of folding outward thereby permitting the insertion of a drinking straw through drink-through opening 18. Furthermore, the four flaps 47 served to stabilize and partially seal the inserted drinking straw within drink-through opening 18 regardless of the diameter of the drinking straw being used.

The effectiveness of baffle 40 can be further improved by an increased depth of cavity 41 formed during molding as measured by its downwardly extension from annular top wall 11 shown in FIG. 5. However, the depth of cavity 41 is limited by the physical characteristics of the thermoplastic material which thins while forming into the downward extension. To a certain extent, thinning of the material within cavity 41 is desirable. When a drinking straw is inserted through the drink-through opening 18, the flaps 47 should be sufficiently flexible to fold outward without collapsing the straw. Material strength is not a consideration for deflecting liquids sloshing within the cup, however, the material forming cavity 41 cannot be so weak that baffle 40 collapses in upon itself while the user sucks liquid through drink-through opening 18.

It will thus be seen the present invention provides a new and improved drink-through disposable dome lid having a number of advantages and characteristics, including those pointed out herein and others which are inherent in the invention. Whereas the invention illustrates and describes several preferred embodiments, it is anticipated that modifications to the described forms of product will occur to those skilled in the art and that such modification and changes may be made without departing from the spirit of the invention or the scope of the claims that follow.

What is claimed is:

1. A disposable dome lid for mounting upon the substantially circular lip of a disposable drinking cup, the lid comprising:

a mounting portion that anchors upon the cup lip;

an annular outer sidewall portion sloping upwardly and radially inwardly from said mounting portion thereby providing a volume extension means within said lid;

a top wall portion formed at the top of said outer sidewall portion enclosing the top of said outer sidewall portion;

a drinking orifice portion extending downward within said top wall portion and adjacent to said outer sidewall portion and adapted to enable drinking from the cup without removal of said lid and permitting the lips of a user to encompass said drinking orifice portion, with the lower lip of said user engaging with said outer sidewall portion;

said drinking orifice portion comprising baffles extending downward and terminating above the mounting portion and defining a first opening formed in a first plane and at least one other opening formed in at least one other plane, the first opening and the at least one other opening formed contiguous to one another to form a multiplanar opening in three dimensions, the first opening and the at least one other opening comprise a plurality of contiguous slotted openings, with the baffles being sufficiently flexible to permit the insertion of a drinking straw through the drink-through opening.

2. The lid of claim 1 wherein the internal wall formed about the perimeter of said drinking orifice portion forms a pair of generally parallel straight edges connected at their extremities by a pair of generally rounded edges in said top wall portion, with planar surfaces downwardly extending from said straight edges and rounded surfaces downwardly extending from said round edges, where said rounded and planar surfaces converge to form a bottom surface, with all of said surfaces comprising said cavity portion, with said cavity portion stamped to created said drink-through opening, wherein said drink-through opening includes a generally vertically positioned triangular opening portion having a base aligned with the bottom of said barrier wall portion and contiguous with a slotted opening portion that extends upward from its apex to become generally horizontally oriented at its termination adjacent to said perimeter of said drinking orifice portion, with both of said opening portions stamped into said depression portion formed into the outermost of said planar surfaces; wherein:

said slotted opening portion permits the remnants of liquid to pass through said drinking orifice otherwise restricted by said barrier wall; and said triangular opening portion enhances the flow of said liquid through said drinking orifice while being generally inaccessible to sloshed liquids;

a second slotted opening portion stamped into the innermost of said planar surfaces, with a length extending vertically and upwardly from the bottom of said barrier wall, with a width generally equal to that of said first slotted opening portion;

a third horizontally positioned slotted opening portion stamped into said bottom surface of said cavity portion, with the plurality of said opening portions being contiguous and providing:

the volume of liquid capable of passing through said drinking orifice to be generally equivalent to that of said drink-through opening having a perimeter of similar shape and size with no said barrier wall portion;

a horizontally oriented cross-sectional shaped opening when viewing directly downward at said drinking orifice portion, with said cross-section shaped opening having rounded extremities and centered cross members; and four flap portions defined by said contiguous opening portions, with said flap portions capable of folding outwardly thereby providing expansion of the narrowest opening portion upon the insertion of a drinking straw through said barrier wall portion without collapsing said straw.

3. A lid, comprising:

a mounting portion, a domed portion and a recessed area formed in the domed portion;

a combined vent-and-drain opening formed in the recessed area and adapted to vent air and drain liquid;

a drink opening formed in the domed portion and comprising baffles extending downward and terminating above the mounting portion and defining a first opening formed in a first plane and at least one other opening formed in at least one other plane, the first opening and the at least one other opening contiguous to one another to form a multiplanar opening in three dimensions; and the first opening and the at least one other opening comprise a plurality of contiguous slotted openings, one of the slotted openings comprising a V-shaped portion having an apex oriented toward the domed portion.

4. The lid of claim 3 wherein a pair of channels are formed in the domed portion with each channel adjacent a respective side of the drink opening, the pair of channels configured to provide a tactile indication of the drink opening location; each channel of the pair of channels is in fluid communication with the recessed area to provide drainage of liquid to the combined vent-and-drain opening.

5. The lid of claim 3 wherein the combined vent-and-drain opening is formed in a depression in the recessed area adjacent the drink opening, the depression sloping away from the drink opening towards a low point at which the combined vent-and-drain opening is formed.

6. The lid of claim 4 wherein the pair of channels each comprises a sloped portion adapted to receive a portion of a user's upper lip to seal the lip around a portion of the drink opening.

7. A lid, comprising:

a drink opening formed in a domed portion of the lid and comprising baffles extending downward and terminating above a mounting portion of the lid and defining a first opening formed in a first plane and at least one other opening formed in at least one other plane, the first opening and the at least one other opening formed contiguous to one another to form a multiplanar opening in three dimensions, the first opening and the at least one other opening comprise a plurality of contiguous slotted openings, one of the slotted openings comprising a V-shaped portion; and a pair of sloped channels, each channel formed adjacent a respective side of the drink opening to provide a tactile indication of the drink opening location in the lid.

8. The lid of claim 7 wherein each of the channels slope toward and are in fluid communication with a recessed area formed in the domed portion, the recessed area having a combined vent-and-drain opening formed therein.

9. The lid of claim 8 wherein the recessed area comprises a depression that slopes away from the drink opening towards a low point in which the combined vent-and-drain opening is formed.

10. The lid of claim 8 wherein the baffles comprise four flexible flaps.

11. A lid for use with a drinking straw, comprising:

a domed portion and a mounting portion; and a drink opening formed in the domed portion comprising an inwardly sloping downward extending internal wall defining an interior perimeter portion that forms a single substantially vertical opening, the internal wall comprising a plurality of flaps, forming baffles extending downward and terminating above the mounting portion and defining a substantially vertical first opening formed in a first plane and at least one other substantially horizontal opening formed in at least one other plane, the substantially vertical first opening and the at least one other horizontal opening formed contiguous to one another to form a single, multiplanar, substantially vertical opening in three dimensions in the internal wall.

12. The lid of claim 11 wherein the baffles comprise four flexible flaps.

13. The lid of claim 11, comprising a pair of sloped channels, each channel formed in the domed portion adjacent a respective side of the drink opening to provide a tactile indication of the drink opening location.

14. The lid of claim 13 wherein the pair of sloped channels are in fluid communication with a recessed area formed in the domed portion, the recessed area having a combined vent-and-drain opening to vent air and drain liquid.

15. The lid of claim 14, comprising a depression formed in the recessed area adjacent the drink opening and sloping away from the drink opening to a low point in which the combined vent-and-drain opening is formed.

16. The lid of claim 14 wherein the pair of channels are adapted to receive a portion of a user's upper lip to seal the lip around a portion of the drink opening.

17. A lid, comprising:

a domed portion and a recessed area formed in the domed portion, the recessed area having a combined vent-and-drain opening formed therein;

means for channeling fluid on an external surface of the domed portion and recessed area to the combined vent-and-drain opening, the channeling means comprising a depression formed in the recessed area adjacent a drink opening formed in the domed portion and sloping away from the drink opening to a low point in which the combined vent-and-drain opening is formed; and the drink opening comprising an inwardly sloping downward extending internal wall defining an interior perimeter portion that forms a single substantially vertical opening, the internal wall comprising flexible flaps extending downward and terminating above a mounting portion on the lid, each flap comprising a downward extension having a thickness that is thinner than a thickness of the domed portion to enhance flexibility and defining a substantially vertical first opening formed in a first plane and at least one other substantially horizontal opening formed in at least one other plane, the substantially vertical first opening and the at least one other horizontal opening formed contiguous to one another to form the single substantially vertical opening in three dimensions in the internal wall.

18. The lid of claim 17, comprising a pair of sloped channels, each sloped channel formed adjacent a respective side of the drink opening and adapted to provide a tactile indication of the drink opening location.

19. The lid of claim 18 wherein each channel of the pair of sloped channels is adapted to receive a portion of a user's upper lip to seal the lip around a portion of the drink opening.

20. The lid of claim 19 wherein the drink opening comprises at least two contiguous openings adapted to receive and hold a straw.

21. A disposable dome lid for mounting upon the substantially circular lip of a disposable drinking cup and accommodating a drink straw, the lid comprising:

a mounting portion that anchors upon the cup lip;

an annular outer sidewall portion sloping upwardly and radially inwardly from said mounting portion thereby providing a volume extension means within said lid;

a top wall portion formed at the top of said outer sidewall portion enclosing the top of said outer sidewall portion;

a drinking orifice portion within said top wall portion and adjacent to said outer sidewall portion and adapted to enable drinking from the cup without removal of said lid and permitting the lips of a user to encompass said drinking orifice portion, with the lower lip of said user engaging with said outer sidewall portion;

said drinking orifice portion comprising a downwardly extending inwardly sloping internal wall formed about the interior perimeter of said drinking orifice portion to define a cavity, the inwardly sloping internal wall comprising a substantially vertical wall portion that projects into the cavity, and a drink-through opening formed in the inwardly sloping internal wall including the substantially vertical wall portion and comprising a plurality of flap members extending downward and terminating above the mounting portion and depending downward into the cavity from adjacent the top wall portion to a free end of the flap members at a bottom of the cavity, the flap members defining a vertical opening between each pair of the flap members that merges into a single horizontal opening at the bottom of the cavity, the flap members thereby forming a barrier wall portion from the internal wall that is configured to permit liquid to flow through said drinking orifice portion while shielding against the sloshing of liquid out of the drinking orifice portion.

22. A disposable dome lid for mounting upon the substantially circular lip of a disposable drinking cup, the lid comprising:

a mounting portion that anchors upon the cup lip;

an annular outer sidewall portion sloping upwardly and radially inwardly from the mounting portion thereby providing a volume extension means within the lid;

a top wall portion formed at the top of the outer sidewall portion enclosing the top of the outer sidewall portion;

a drinking orifice portion extending downwardly within the top wall portion and adjacent to the outer sidewall portion and adapted to enable drinking from the cup without removal of the lid and permitting the lips of a user to encompass the drinking orifice portion, with the lower lip of the user engaging with the outer sidewall portion;

the drinking orifice portion comprising baffles extending downwardly and terminating above the mounting portion and defining a first opening formed in a first plane and at least one other opening formed in at least one other plane, the first opening and the at least one other opening formed contiguous to one another to form a multiplanar opening in three dimensions, the first opening and the at least one other opening comprise a plurality of contiguous slotted openings, with the baffles being sufficiently flexible to permit the insertion of a drinking straw through the drink-through opening; and wherein the internal wall formed about the perimeter of the drinking orifice portion forms a pair of generally parallel straight edges connected at their extremities by a pair of generally rounded edges in the top wall portion, with planar surfaces downwardly extending from the straight edges and rounded surfaces downwardly extending from the round edges, where the rounded and planar surfaces converge to form a bottom surface, with all of the surfaces comprising the cavity portion, with the cavity portion stamped to created the drink-through opening, wherein the drink-through opening includes a generally vertically positioned triangular opening portion having a base aligned with the bottom of the barrier wall portion and contiguous with a slotted opening portion that extends upward from its apex to become generally horizontally oriented at its termination adjacent to the perimeter of the drinking orifice portion, with both of the opening portions stamped into the depression portion formed into the outermost of the planar surfaces; wherein:

the slotted opening portion permits the remnants of liquid to pass through the drinking orifice otherwise restricted by the barrier wall; and the triangular opening portion enhances the flow of the liquid through the drinking orifice while being generally inaccessible to sloshed liquids;

a second slotted opening portion stamped into the innermost of the planar surfaces, with a length extending vertically and upwardly from the bottom of the barrier wall, with a width generally equal to that of the first slotted opening portion;

a third horizontally positioned slotted opening portion stamped into the bottom surface of the cavity portion, with the plurality of the opening portions being contiguous and providing:

the volume of liquid capable of passing through the drinking orifice to be generally equivalent to that of the drink-through opening having a perimeter of similar shape and size with no the barrier wall portion;

a horizontally oriented cross-sectional shaped opening when viewing directly downward at the drinking orifice portion, with the cross-section shaped opening having rounded extremities and centered cross members; and four flap portions defined by the contiguous opening portions, with the flap portions capable of folding outwardly thereby providing expansion of the narrowest opening portion upon the insertion of a drinking straw through the barrier wall portion without collapsing the straw.

* * * * *